US008070261B2

(12) United States Patent
Nagashima

(10) Patent No.: US 8,070,261 B2
(45) Date of Patent: Dec. 6, 2011

(54) LIQUID EJECTION HEAD AND IMAGE FORMING APPARATUS

(75) Inventor: Kanji Nagashima, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 12/967,942

(22) Filed: Dec. 14, 2010

(65) Prior Publication Data

US 2011/0080453 A1 Apr. 7, 2011

Related U.S. Application Data

(62) Division of application No. 11/519,852, filed on Sep. 13, 2006, now Pat. No. 7,874,657.

(30) Foreign Application Priority Data

Sep. 14, 2005 (JP) ..... 2005-267020

(51) Int. Cl.
*B41J 2/05* (2006.01)
*B41J 29/38* (2006.01)

(52) U.S. Cl. ..... 347/56; 347/10; 347/11; 347/14

(58) Field of Classification Search ..... 347/10, 347/11, 14, 85
See application file for complete search history.

(56) References Cited

U.S. PATENT DOCUMENTS

| | | | | |
|---|---|---|---|---|
| 5,646,662 | A | 7/1997 | Kitahara | |
| 5,880,756 | A | 3/1999 | Ishii et al. | |
| 6,126,270 | A * | 10/2000 | Lebens et al. | 347/48 |
| 6,206,501 | B1 | 3/2001 | Ishii et al. | |
| 7,399,060 | B2 | 7/2008 | Tsuchii | |
| 2002/0093547 | A1 * | 7/2002 | Dante et al. | 347/48 |
| 2004/0155915 | A1 | 8/2004 | Kitami et al. | |
| 2005/0110834 | A1 | 5/2005 | Norkitis et al. | |
| 2006/0119630 | A1 * | 6/2006 | Kuwahara et al. | 347/12 |

FOREIGN PATENT DOCUMENTS

| | | | |
|---|---|---|---|
| JP | 2-11331 | A | 1/1990 |
| JP | 7-195685 | A | 8/1995 |
| JP | 9-109387 | A | 4/1997 |
| JP | 2004-202707 | A | 7/2004 |
| JP | 2004-262237 | A | 9/2004 |
| JP | 2005-95746 | A | 4/2005 |
| JP | 2005-153522 | A | 6/2005 |

* cited by examiner

*Primary Examiner* — Matthew Luu
*Assistant Examiner* — Lisa Solomon
(74) *Attorney, Agent, or Firm* — Birch, Stewart, Kolasch & Birch, LLP

(57) ABSTRACT

The liquid ejection head comprises: a nozzle from which liquid is ejected; a pressure chamber which accommodates the liquid to be ejected from the nozzle; a pressurizing device which deforms to pressurize the liquid in the pressure chamber to eject the liquid from the nozzle; and a nozzle flow channel through which the pressurized liquid flows from the pressure chamber to the nozzle, the nozzle flow channel having at least a portion in which forces acting toward an axis of the nozzle flow channel onto the liquid flowing inside the nozzle flow channel are not uniform within a cross-section perpendicular to the axis.

9 Claims, 16 Drawing Sheets

LIQUID EJECTION HEAD AND IMAGE FORMING APPARATUS

This application is a Divisional of application Ser. No. 11/519,852, filed on Sep. 13, 2006 now U.S. Pat. No. 7,874,657, for which priority is claimed under 35 U.S.C. §120. Application Ser. No. 11/519,852 claims priority under 35 U.S.C. §119(a)-(d) on Application No. 2005-267020 filed in Japan on Sep. 14, 2005, the entire contents of which are hereby incorporated by reference.

BACKGROUND OF THE INVENTION

1. Field of the Invention

The present invention relates to a liquid ejection head and image forming apparatus, and more particularly, to a liquid ejection head and image forming apparatus in which ejection errors such as nozzle blockages are prevented by causing slight vibration of the meniscus to an extent which does not cause ejection of liquid.

2. Description of the Related Art

In an inkjet type of print head, if there is a long non-ejection period during which no ink droplets are ejected from the nozzles, then ejection errors may arise, such as variation of the ejected ink droplets in the volume, the direction of flight, the speed of flight, and the like, and nozzle blockages, due to drying and increase in the viscosity of the ink nearby the meniscus inside the nozzles. Therefore, the image quality may be degraded. A method is known in which, in cases such as this, the ink of increased viscosity inside the nozzles is expelled by performing preliminary ejection (purging), which is not related to printing. However, there is a problem with methods of this kind in that the ink consumption is high.

Therefore, methods have been disclosed for reducing the increase in the viscosity of the ink inside the nozzles, by performing slight vibration of the meniscus to an extent which does not cause ejection of ink droplets from the nozzles (in other words, pulsation of the meniscus) (see, for example, Japanese Patent Application Publication Nos. 2005-95746, 2004-262237 and 2004-202707).

However, the ink inside the nozzles is not churned sufficiently, simply by causing slight vibration of the meniscus, and hence it may not be possible to reduce the increase in the viscosity of the ink.

FIG. 23 shows an example of a print head in the related art, in which the upper part shows an enlarged cross-sectional diagram of the periphery of a nozzle and the lower part is a plan diagram viewed from the side of the nozzle. As shown in FIG. 23, a nozzle flow channel 160 provided in the print head in the related art has a cylindrical section 160*a* and a tapered section 160*b*, and a nozzle 151, which is an opening section, is formed on the side of the tapered section 160*b*. The cross-section perpendicular to the axial direction of the nozzle flow channel 160 is circular at all positions along the axial direction, and the cross-section therefore has a congruent or similar shape with axial symmetry. As shown in FIG. 24, when ink is not being ejected, the meniscus is oscillated (caused to vibrate slightly) upward and downward to an extent which does not cause ejection of an ink droplet, thereby reducing the increase in the viscosity of the ink inside the nozzle flow channel 160. FIG. 25 is an oblique diagram which shows a three-dimensional representation of the internal structure of the nozzle flow channel 160. In FIG. 25, taking the internal diameter of the nozzle flow channel 160 (cylindrical section 160*a*), to be d, taking the viscosity coefficient of the fluid (namely, ink) flowing inside the nozzle flow channel 160, to be ν, and taking the average flow speed of the fluid to be u, then the Reynolds number R (=ud/ν) which indicates the state of flow of the fluid can be found. If the Reynolds number R becomes greater than the critical Reynolds number Rc (=2310), then the flow becomes turbulent, and conversely, if it is smaller, then the flow is a laminar flow. If it is possible to create a turbulent flow in the ink inside the nozzle flow channel 160 during vibration of the meniscus, then the ink is churned and hence it is possible effectively to reduce the increase in the viscosity of the ink. However, generally, in an inkjet type of print head, the internal diameter d of the nozzle flow channel 160 is small and it is difficult to make the Reynolds number R greater than the critical Reynolds number Rc. For example, in an inkjet apparatus using water-based ink, the kinematic viscosity of the ink is substantially equal to that of water, at 0.013 $cm^2$/sec, and if d=0.1 mm, then the average speed u required in order to achieve the critical Reynolds number Rc is approximately 30 msec, whereas the actual average speed u is approximately 15 to 20 m/sec. Therefore, a turbulent flow cannot be obtained simply by vibrating the meniscus, and the ink inside the nozzle flow channel 160 cannot be churned satisfactorily.

Furthermore, in the tapered section 160*b* of the nozzle flow channel 160, compressive forces toward the axis of the nozzle flow channel 160 act onto the ink. Theses forces change isotropically in the axial direction, in other words, they simply increase gradually toward the nozzle 151, and they do not allow the ink to be churned satisfactorily.

As described above, in the print head in the related art, it is not possible to reduce increase in the viscosity of the ink effectively. In particular, in a single-pass type of print head, if printing continues over a long period of time, it is difficult to perform preliminary ejection frequently in comparison with a shuttle scan type of print head, and therefore it is necessary to improve the churning effect of the ink during the vibration of the meniscus.

SUMMARY OF THE INVENTION

The present invention has been contrived in view of the foregoing circumstances, an object thereof being to provide a liquid ejection head and image forming apparatus whereby the ink churning effect during vibration of the meniscus is improved.

In order to attain the aforementioned object, the present invention is directed to a liquid ejection head, comprising: a nozzle from which liquid is ejected; a pressure chamber which accommodates the liquid to be ejected from the nozzle; a pressurizing device which deforms to pressurize the liquid in the pressure chamber to eject the liquid from the nozzle; and a nozzle flow channel through which the pressurized liquid flows from the pressure chamber to the nozzle, the nozzle flow channel having at least a portion in which forces acting toward an axis of the nozzle flow channel onto the liquid flowing inside the nozzle flow channel are not uniform within a cross-section perpendicular to the axis.

According to this aspect of the present invention, since the liquid inside the nozzle flow channel is churned efficiently during vibration of the meniscus, then it is possible effectively to prevent increase in the viscosity of the liquid. Consequently, it is possible to prevent ejection errors and therefore, a high-quality image can be formed.

Preferably, the nozzle flow channel has at least two cross-sections having dissimilar cross-sectional shapes perpendicular to the axis.

According to this aspect of the present invention, it is possible to generate a force perpendicular to the axial direction of the nozzle flow channel, efficiently.

Alternatively, it is also preferable that the nozzle flow channel has at least two cross-sectional shapes perpendicular to the axis that have similarity when rotated on the axis.

According to this aspect of the present invention, the liquid ejection head can be manufactured relatively easily.

Alternatively, it is also preferable that the nozzle flow channel includes a section in which centers of cross-sections perpendicular to the axis vary along the axis.

Preferably, the nozzle flow channel is formed in a member laminated from a plurality of plate members.

Preferably, at least one of the plate members is a nozzle plate in which the nozzle is formed.

In order to attain the aforementioned object, the present invention is also directed to a liquid ejection head, comprising: a nozzle from which liquid is ejected; a pressure chamber which accommodates the liquid to be ejected from the nozzle; a pressurizing device which deforms to pressurize the liquid in the pressure chamber to eject the liquid from the nozzle; a nozzle flow channel through which the pressurized liquid flows from the pressure chamber to the nozzle; and a heater which is arranged at a portion of an inner wall of the nozzle flow channel.

Preferably, a first heater and a second heater are arranged at portions of the inner wall at different heights in an axial direction of the nozzle flow channel and opposing to each other.

In order to attain the aforementioned object, the present invention is also directed to an ink ejection head, comprising: a nozzle from which ink is ejected; a pressure chamber which accommodates the ink to be ejected from the nozzle; a pressurizing device which deforms to pressurize the ink in the pressure chamber to eject the ink from the nozzle; a nozzle flow channel through which the pressurized ink flows from the pressure chamber to the nozzle; and an injection port through which one of a solvent contained in the ink and the ink having a density different from the ink existing inside the nozzle flow channel is injected into the nozzle flow channel.

In order to attain the aforementioned object, the present invention is also directed to a liquid ejection head, comprising: a nozzle from which liquid is ejected; a pressure chamber which accommodates the liquid to be ejected from the nozzle; a pressurizing device which deforms to pressurize the liquid in the pressure chamber to eject the liquid from the nozzle; a nozzle flow channel through which the pressurized liquid flows from the pressure chamber to the nozzle; and a plate member which is arranged inside the nozzle flow channel, the plate member being inclined obliquely with respect to an axis of the nozzle flow channel, a gap being formed between an inner wall of the nozzle flow channel and an outer side of each end of the plate member.

In order to attain the aforementioned object, the present invention is also directed to a liquid ejection head, comprising: a nozzle from which liquid is ejected; a pressure chamber which accommodates the liquid to be ejected from the nozzle; a pressurizing device which deforms to pressurize the liquid in the pressure chamber to eject the liquid from the nozzle; a nozzle flow channel through which the pressurized liquid flows from the pressure chamber to the nozzle; and an elastic movable film which is arranged at a portion of an inner wall of the nozzle flow channel.

In order to attain the aforementioned object, the present invention is also directed to a liquid ejection head, comprising: a nozzle from which liquid is ejected; a pressure chamber which accommodates the liquid to be ejected from the nozzle; a pressurizing device which deforms to pressurize the liquid in the pressure chamber to eject the liquid from the nozzle; and a nozzle flow channel through which the pressurized liquid flows from the pressure chamber to the nozzle, the nozzle flow channel having an inner wall formed with alternately repeated recesses and projections along an axial direction of the nozzle flow channel.

In order to attain the aforementioned object, the present invention is also directed to a liquid ejection head, comprising: a nozzle from which liquid is ejected; a pressure chamber which accommodates the liquid to be ejected from the nozzle; a pressurizing device which deforms to pressurize the liquid in the pressure chamber to eject the liquid from the nozzle; and a nozzle flow channel through which the pressurized liquid flows from the pressure chamber to the nozzle, the nozzle flow channel having a restrictor section in which a cross-sectional area perpendicular to an axial direction of the nozzle flow channel is reduced in comparison with other sections of the nozzle flow channel.

According to these aspects of the present invention, since the liquid inside the nozzle flow channel is churned efficiently during vibration of the meniscus, then it is possible effectively to prevent increase in the viscosity of the liquid.

In order to attain the aforementioned object, the present invention is also directed to an image forming apparatus, comprising the above-described liquid ejection head.

According to the present invention, since the liquid inside the nozzle flow channel is churned efficiently during vibration of the meniscus, then it is possible effectively to prevent increase in the viscosity of the liquid. Consequently, it is possible to prevent ejection errors and therefore, a high-quality image can be formed.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Inkjet Recording Apparatus

Figure 1:
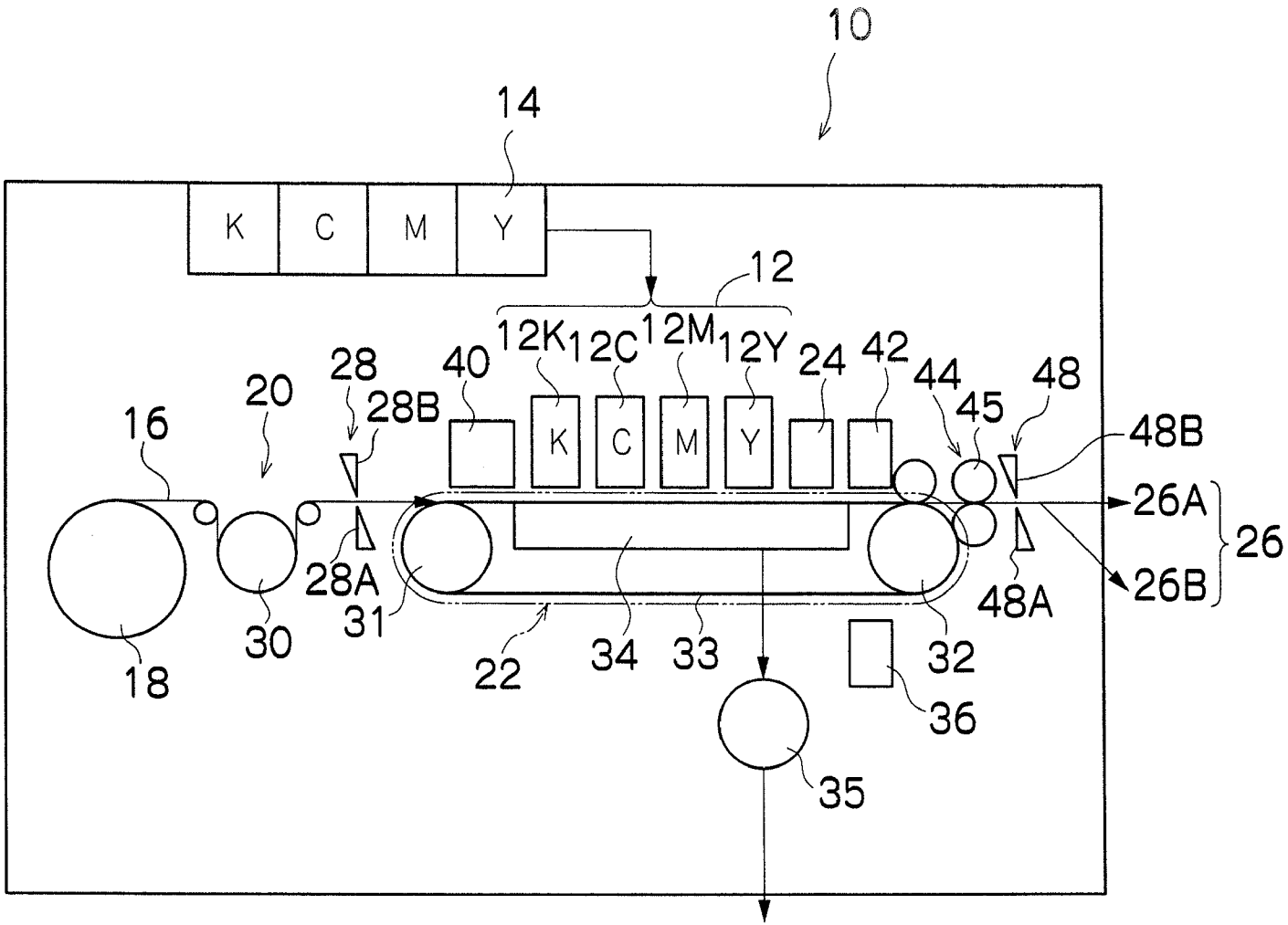
FIG. 1 is a general schematic drawing showing an inkjet recording apparatus according to an embodiment of the present invention.

FIG. 1 is a diagram of the general composition showing an outline of an inkjet recording apparatus as an image forming apparatus according to the present invention. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the printing unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a magazine for rolled paper (continuous paper) is shown as an embodiment of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which roll paper is used, a cutter 28 is provided as shown in FIG. 1, and the roll paper is cut to a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a plane.

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 on the belt 33 is held by suction. The belt 33 is driven in the clockwise direction in FIG. 1 by the motive force of a motor 88 (not shown in drawings) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, embodiments thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

The printing unit 12 is a so-called "full line head" in which a line head having a length corresponding to the maximum paper width is arranged in a direction (main-scanning direction) that is perpendicular to the paper conveyance direction (sub-scanning direction). Each of the print heads 12K, 12C, 12M, and 12Y forming the printing unit 12 is constituted by a line head, in which a plurality of ink ejection ports (nozzles) are arranged along a length that exceeds at least one side of the maximum-size recording paper 16 intended for use in the inkjet recording apparatus 10.

The print heads 12K, 12C, 12M, and 12Y are arranged in the order of black (K), cyan (C), magenta (M), and yellow (Y) from the upstream side (the left side in FIG. 1), along the feed direction of the recording paper 16 (paper conveyance direction). A color image can be formed on the recording paper 16 by ejecting the inks from the print heads 12K, 12C, 12M, and 12Y, respectively, while conveying the recording paper 16.

The printing unit 12, in which the full-line heads covering the entire width of the paper are thus provided for the respective ink colors, can record an image over the entire surface of the recording paper 16 by performing the action of moving the recording paper 16 and the printing unit 12 relative to each other in the paper conveyance direction (sub-scanning direction) just once (in other words, by means of a single sub-scan). Higher-speed printing is thereby made possible and productivity can be improved in comparison with a shuttle type head configuration in which a print head moves reciprocally in a direction (main scanning direction) that is perpendicular to the paper conveyance direction.

Although the configuration with the KCMY four standard colors is described in the present embodiment, combinations of the ink colors and the number of colors are not limited to those. Light inks or dark inks can be added as required. For example, a configuration is possible in which print heads for ejecting light-colored inks such as light cyan and light magenta are added.

As shown in FIG. 1, the ink storing and loading unit 14 has ink tanks for storing the inks of the colors corresponding to the respective print heads 12K, 12C, 12M, and 12Y, and the respective tanks are connected to the print heads 12K, 12C, 12M, and 12Y by means of channels (not shown). The ink storing and loading unit 14 has a warning device (for example, a display device, an alarm sound generator, or the like) for warning when the remaining amount of any ink is low, and has a mechanism for preventing loading errors among the colors.

The print determination unit 24 has an image sensor (line sensor or the like) for capturing an image of the ink-droplet deposition result of the printing unit 12, and functions as a device to check for ejection defects such as clogs of the nozzles from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the print heads 12K, 12C, 12M, and 12Y for the respective colors, and the ejection of each head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in drawings, the paper output unit 26A for the target prints is provided with a sorter for collecting prints according to print orders.

The print heads 12K, 12M, 12C and 12Y provided for the respective ink colors have the same structure, and a reference numeral 50 is hereinafter designated to a representative embodiment of these print heads.

Description of Control System

Next, the control system of the inkjet recording apparatus 10 is described.

Figure 2:
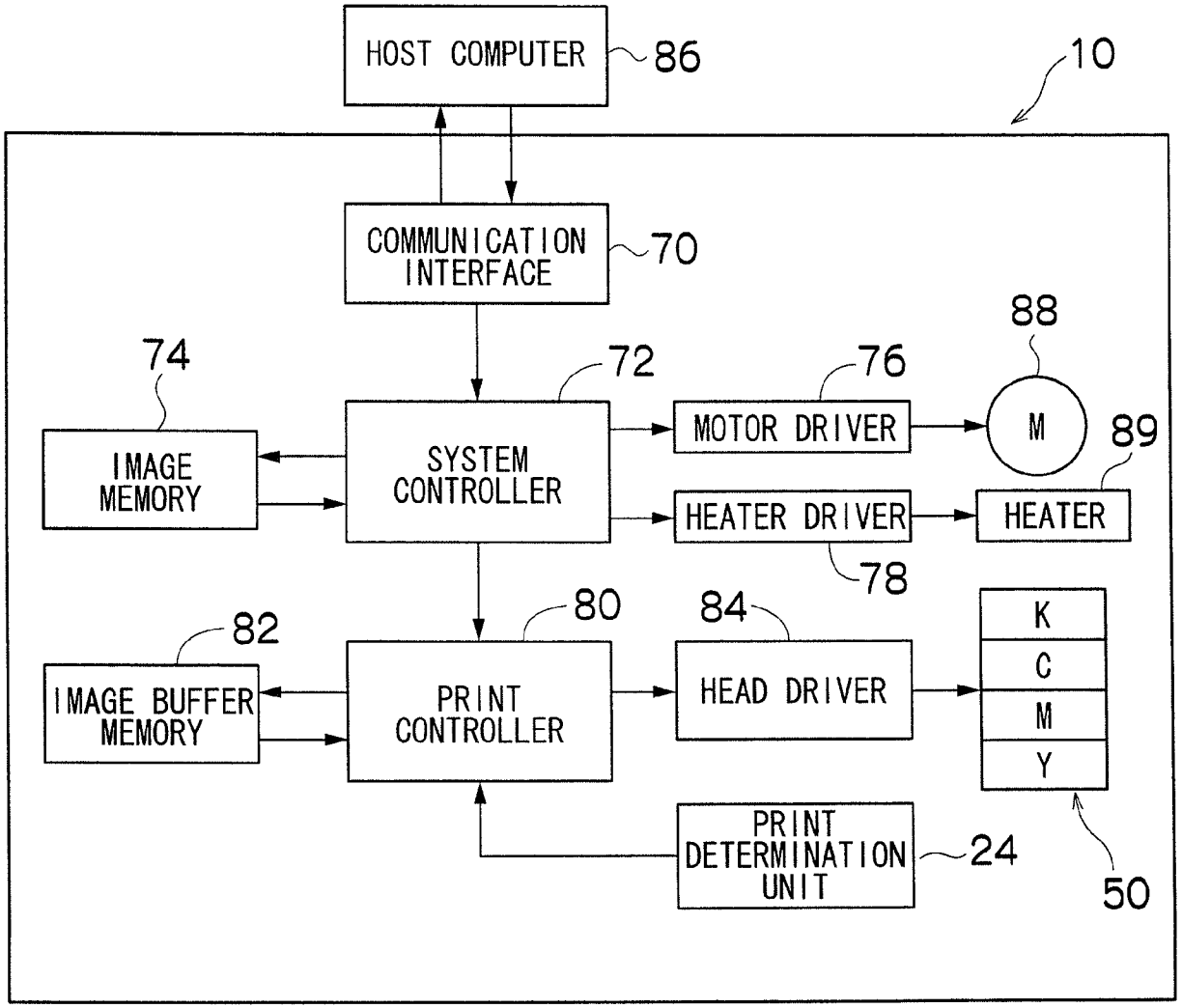
FIG. 2 is a principal block diagram showing the system composition of the inkjet recording apparatus.

FIG. 2 is a principal block diagram showing the system configuration of the inkjet recording apparatus 10. The inkjet recording apparatus 10 comprises a communication interface 70, a system controller 72, an image memory 74, a motor driver 76, a heater driver 78, a print controller 80, an image buffer memory 82, a head driver 84, and the like.

The communication interface 70 is an interface unit for receiving image data sent from a host computer 86. A serial interface or a parallel interface may be used as the communication interface 70. A buffer memory (not shown) may be mounted in this portion in order to increase the communication speed.

The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is a control unit for controlling the various sections, such as the communication interface 70, the image memory 74, the motor driver 76, and the heater driver 78. The system controller 72 is constituted by a central processing unit (CPU) and peripheral circuits thereof, and the like, and in addition to controlling communications with the host computer 86 and controlling reading and writing from and to the image memory 74, or the like, it also generates a control signal for controlling the motor 88 of the conveyance system and the heater 89.

The motor driver 76 is a driver (drive circuit) which drives the motor 88 in accordance with commands from the system controller 72. The heater driver 78 drives the heater 89 of the post-drying unit 42 or other units in accordance with commands from the system controller 72.

The print controller 80 has a signal processing function for performing various tasks, compensations, and other types of processing for generating print control signals from the image data stored in the image memory 74 in accordance with commands from the system controller 72 so as to supply the generated print control signal (dot data) to the head driver 84. Prescribed signal processing is carried out in the print controller 80, and the ejection amount and the ejection timing of the ink droplets from the respective print heads 50 are controlled via the head driver 84, on the basis of the print data. By this means, prescribed dot size and dot positions can be achieved.

The print controller 80 is provided with the image buffer memory 82; and image data, parameters, and other data are temporarily stored in the image buffer memory 82 when image data is processed in the print controller 80. The aspect shown in FIG. 2 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives the piezoelectric elements (not shown in FIG. 2 and indicated by reference numeral 58 in FIG. 4) of the print heads 50 of the respective colors, on the basis of print data supplied by the print controller 80. A feedback control system for maintaining constant drive conditions for the print heads 50 may be included in the head driver 84.

The image data to be printed is externally inputted through the communication interface 70, and is stored in the image memory 74. In this stage, the RGB image data, for example, is stored in the image memory 74. The image data stored in the image memory 74 is sent to the print controller 80 through the system controller 72, and is converted to the dot data for each ink color in the print controller 80 by means of a dither method, an error diffusion method or the like.

In this manner, the print heads 50 are drive-controlled on the basis of the dot data generated in the print controller 80, and ink droplets are ejected from the print heads 50. By controlling ink ejection from the print heads 50 in synchronization with the conveyance velocity of the recording paper 16, an image is formed on the recording paper 16.

The print determination unit 24 is a block that includes the line sensor as described above with reference to FIG. 1, reads the image printed on the recording paper 16, determines the print conditions (presence of the ejection, variation in the dot formation, and the like) by performing desired signal processing, or the like, and provides the determination results of the print conditions to the print controller 80. The read start timing of the line sensor is determined from the distance between the sensor and the nozzle, and the conveyance speed of the recording paper 16.

According to requirements, the print controller 80 makes various corrections with respect to the print head 50 on the basis of information obtained from the print determination unit 24. The print controller 80 judges whether or not the nozzles 51 have performed ejection, on the basis of the determination information obtained by means of the print determination unit 24, and if the print controller 80 detects a nozzle that has not performed ejection, then it implements control for performing a prescribed restoring operation.

Structure of Print Head

Next, embodiments of the print heads 50 (12K, 12C, 12M and 12Y) installed in the inkjet recording apparatus 10 shown in FIG. 1 are described.

First Embodiment

Figure 3:
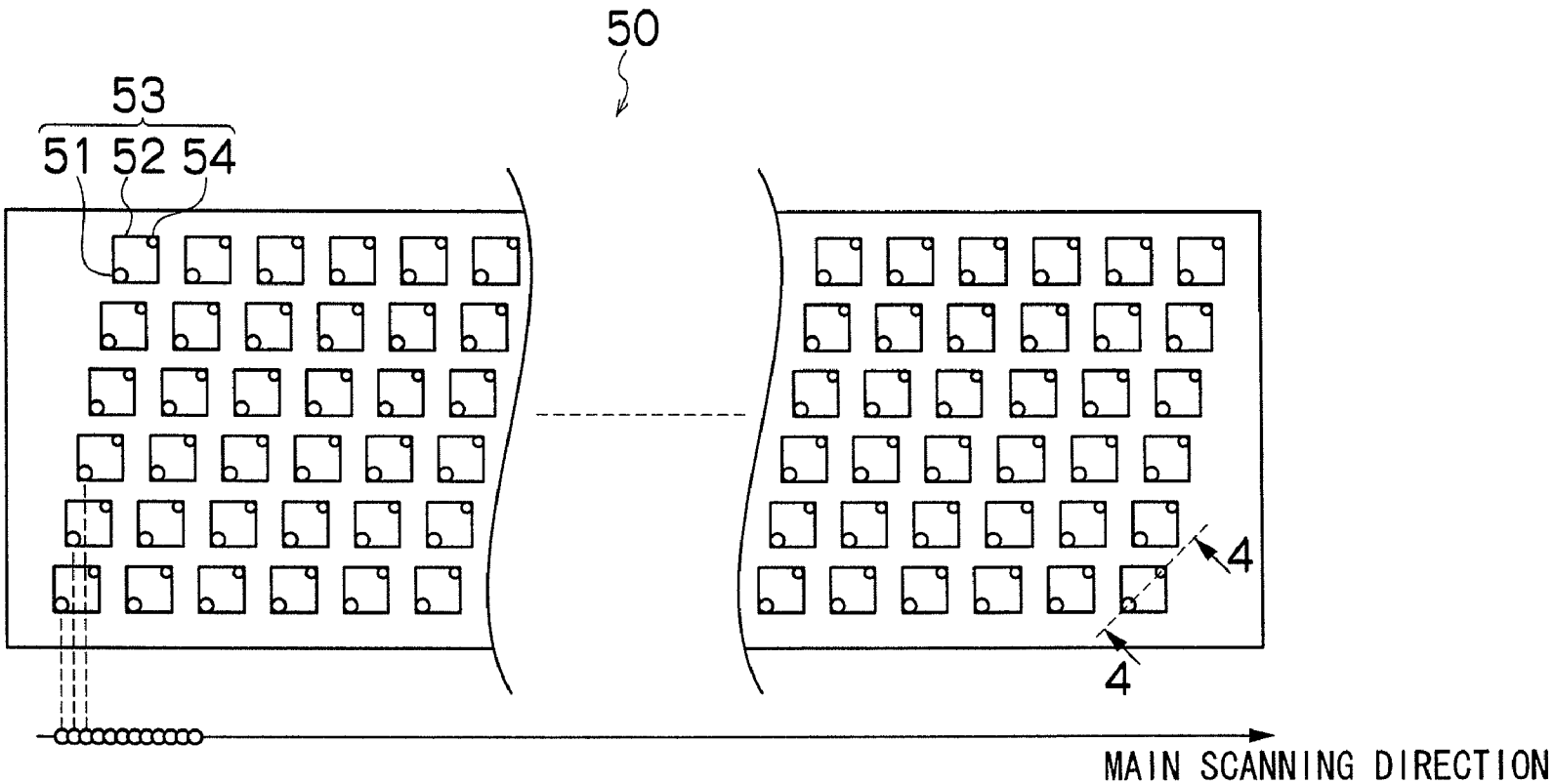
FIG. 3 is a plan view perspective diagram of the print head according to a first embodiment.

FIG. 3 is a plan view perspective diagram of the print head 50 according to the first embodiment. As shown in FIG. 3, the print head 50 of the present embodiment has a structure in which pressure chamber units 53, each comprising a nozzle 51, a pressure chamber 52 and a supply port 54, are arranged in a staggered matrix configuration (two-dimensional configuration). The projected nozzle row obtained by projecting the nozzles to an alignment in the lengthwise direction of the print head 50 (main scanning direction) has nozzles arranged at a uniform nozzle pitch, and a high resolution can be achieved for the pitch of the dots printed onto the surface of the recording paper.

Figure 4:
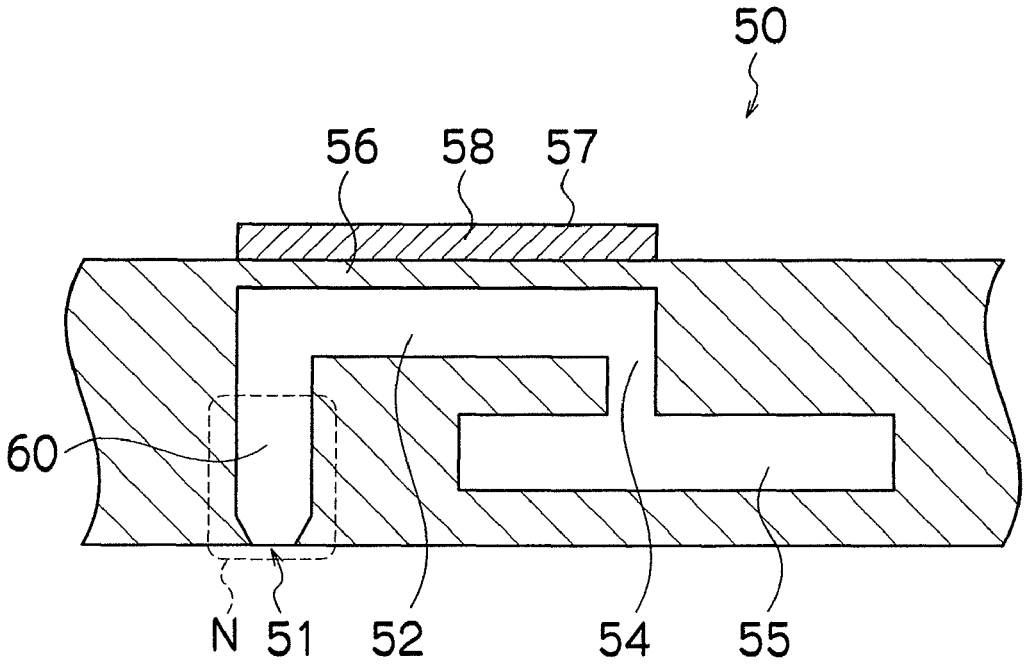
FIG. 4 is a cross-sectional diagram along line 4-4 in FIG. 3.

FIG. 4 is a cross-sectional diagram along line 4-4 in FIG. 3. As shown in FIG. 4, one end of the nozzle flow channel 60 forms the nozzle 51 which opens on the ink ejection surface of the print head 50. The other end of the nozzle flow channel 60 is connected to the pressure chamber 52. A supply port 54 is formed in the pressure chamber 52, and the pressure chamber 52 is connected to a common flow channel 55 through the supply port 54. The common flow channel 55 accumulates ink to be supplied from the ink storing and loading unit 14 in FIG. 1, and the ink is supplied to the pressure chamber 52 from the common flow chamber 55 through the supply port 54. In FIG. 4, the region N including the nozzle 51 side of the nozzle flow channel 60, which is the characteristic feature of the present invention, is depicted in a simplified fashion. The detailed composition of the region N is described hereinafter.

Piezoelectric elements 58 (corresponding to pressure generating elements), each having individual electrodes 57, are provided on the diaphragm 56 which forms the upper wall of the pressure chambers 52, at positions corresponding to the pressure chambers 52. The diaphragm 56 is made of a conductive member such as stainless steel, or the like, and also serves as a common electrode for the plurality of piezoelectric elements 58. It is also possible to make the diaphragm 56 from a non-conducting member and to form a conductive layer on the surface thereof. When a drive signal (drive voltage) is applied to a piezoelectric element 58, the piezoelectric element 58 deforms in such a manner that it causes the diaphragm 56 to bend toward the pressure chamber 52 side, whereby the ink inside the pressure chamber 52 is pressurized and an ink droplet is ejected from the nozzle 51.

Figure 5:
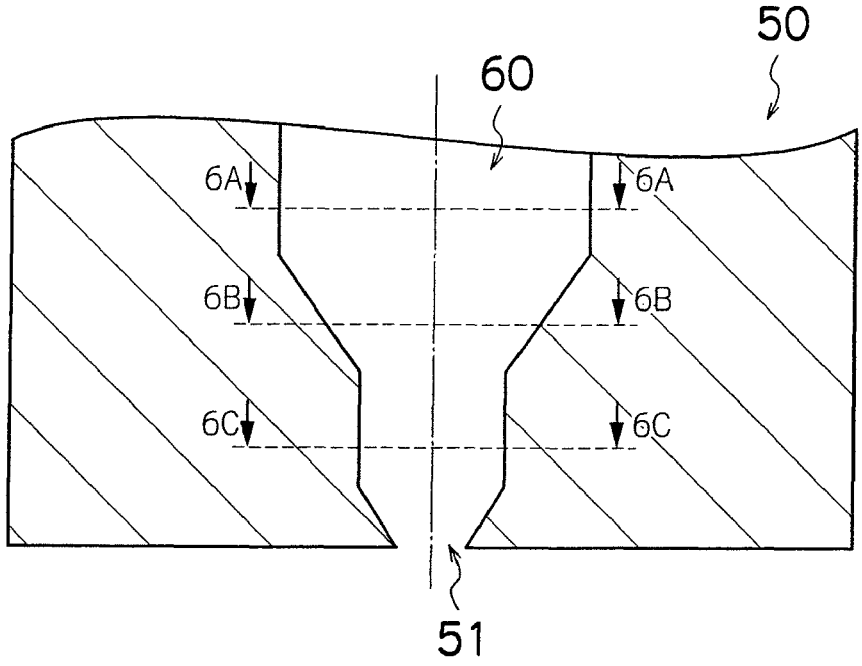
FIG. 5 is a partial enlarged cross-sectional view of FIG. 4.
Figure 6A:
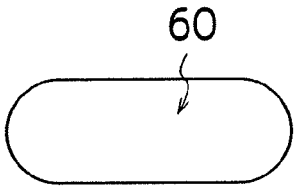
FIGS. 6A to 6C are cross-sectional views perpendicular to the axial direction of the nozzle flow channel in FIG. 5.
Figure 6B:
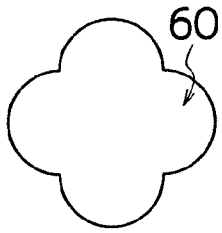
Figure 6C:
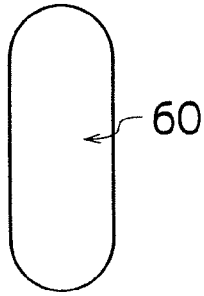
Figure 7:
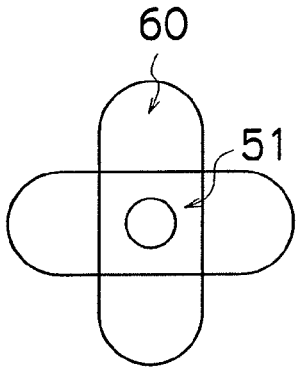
FIG. 7 is a plan view perspective diagram of the nozzle flow channel in FIG. 5, as viewed from the nozzle side.
Figure 8:
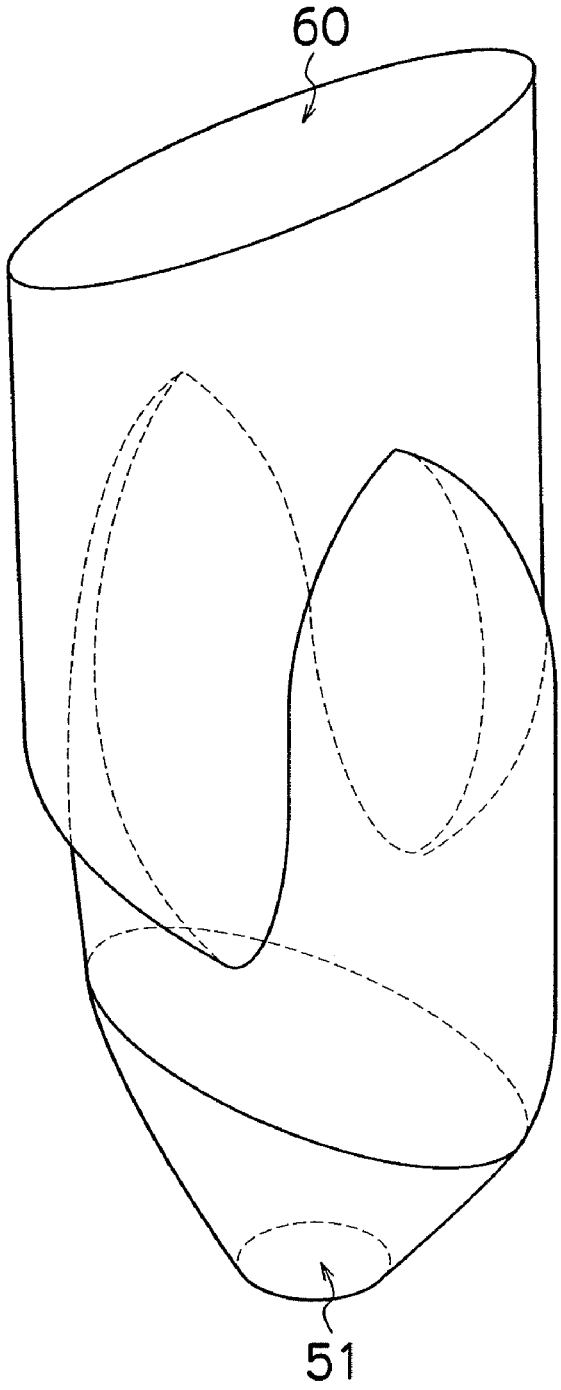
FIG. 8 is an oblique diagram which shows a three-dimensional representation of the internal structure of the nozzle flow channel in FIG. 5.

FIG. 5 is an enlarged cross-sectional diagram of the region N in FIG. 4. FIGS. 6A, 6B and 6C are cross-sectional diagrams along lines 6A-6A, 6B-6B and 6C-6C in FIG. 5, respectively. FIG. 7 is a plan view perspective diagram as viewed from the nozzle 51 side. FIG. 8 is an oblique diagram which shows a three-dimensional representation of the internal structure of the nozzle flow channel 60.

The nozzle flow channel 60 has a cross-section with an oval shape of two types having different longitudinal axial directions (see FIGS. 6A and 6C), and a rounded cross-shaped cross-section which combines these shapes (see FIG. 6B). Furthermore, the nozzle 51 forming one end of the nozzle flow channel 60 has a circular cross-section, as shown in FIG. 7. In other words, following its course in the axial direction, the nozzle flow channel 60 has a plurality of cross-sections of dissimilar shapes in the direction perpendicular to the axial direction. By adopting a composition of this kind, if the ink is moved back and forth inside the nozzle flow channel 60 during vibration of the meniscus, then in the sections where the cross-sectional shape changes, non-uniform forces act onto the ink toward the axis of the nozzle flow channel 60 (in other words, toward the center of the nozzle flow channel 60), within the cross-section perpendicular to the axis, and these forces vary along the axis. Consequently, flows which cause churning of the ink are produced and hence the increase in the viscosity of the ink can be prevented effectively.

The nozzle flow channel 60 of this kind can be manufactured by resin molding, by using separate upper and lower molds, for example.

Second Embodiment

Figure 9:
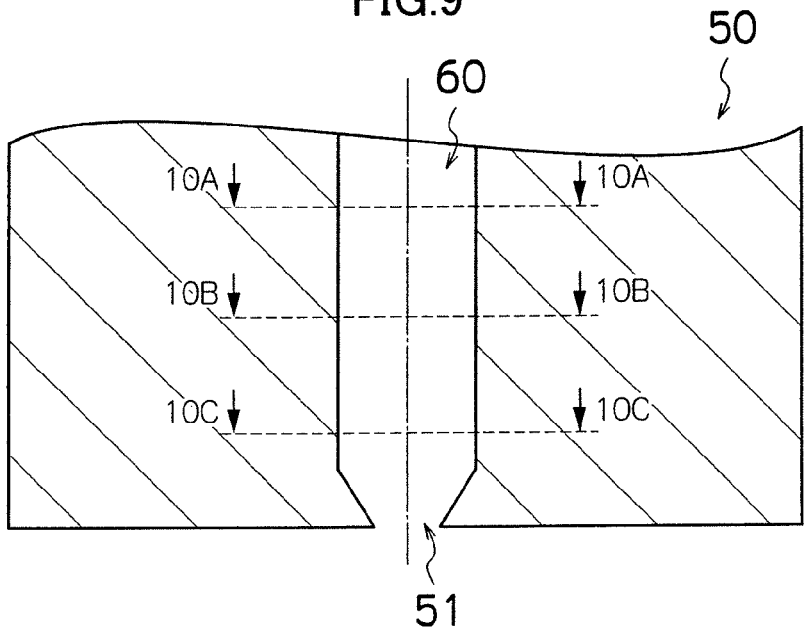
FIG. 9 is an enlarged cross-sectional diagram of the print head according to a second embodiment.
Figure 10A:
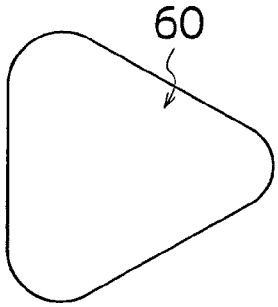
FIGS. 10A to 10C are cross-sectional views perpendicular to the axial direction of the nozzle flow channel in FIG. 9.
Figure 10B:
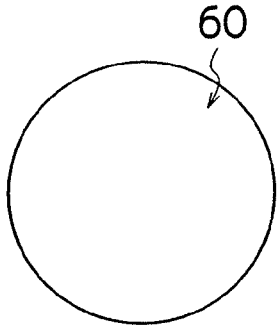
Figure 10C:
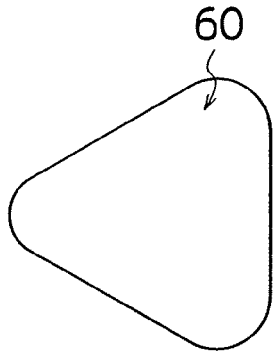
Figure 11:
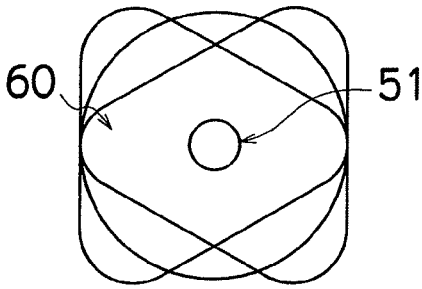
FIG. 11 is a plan view perspective diagram of the nozzle flow channel in FIG. 9, as viewed from the nozzle side.
Figure 12:
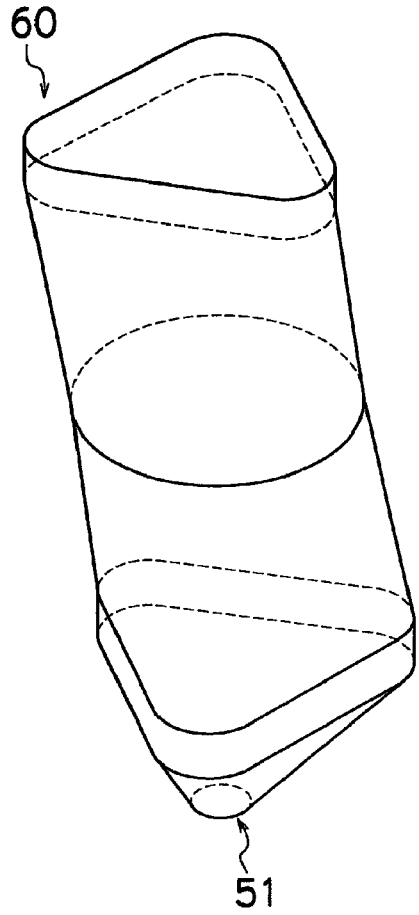
FIG. 12 is an oblique diagram which shows a three-dimensional representation of the internal structure of the nozzle flow channel in FIG. 9.

FIG. 9 is an enlarged cross-sectional diagram of the print head 50 according to a second embodiment. FIGS. 10A, 10B and 10C are cross-sectional diagrams along lines 10A-10A, 10B-10B and 10C-10C in FIG. 9, respectively. FIG. 11 is a plan view perspective diagram as viewed from the nozzle 51 side. FIG. 12 is an oblique diagram which shows a three-dimensional representation of the internal structure of the nozzle flow channel 60.

The nozzle flow channel 60 has two cross-sections of modified triangular shapes (rounded triangular shapes), as shown in FIGS. 10A and 10C. These two cross-sections have a similar (in the present embodiment, a congruent) relationship when either of the cross-sections is rotated on the axis of the nozzle flow channel 60. In other words, the nozzle flow channel 60 comprises two cross-sectional shapes that have a similarity when the phase is changed about the axial direction. Furthermore, the nozzle flow channel 60 has a substantially circular cross-sectional such as that shown in FIG. 10B, between the cross-sections shown in FIGS. 10A and 10C. The cross-sections shown in FIGS. 10A to 10C have substantially the same width (see FIG. 11), and are composed in such a manner that the cross-sections connect together smoothly to form the whole nozzle flow channel 60 (see FIG. 12). By adopting a plurality of cross-sectional shapes that have similarity when rotated on the axis of the nozzle flow channel, for the cross-sectional shape of the nozzle flow channel 60 in the perpendicular direction to the axial direction, then similarly to the first embodiment, the ink inside the nozzle flow channel 60 is churned during vibration of the meniscus, and the increase in the viscosity of the ink can be prevented effectively.

Third Embodiment

Figure 13:
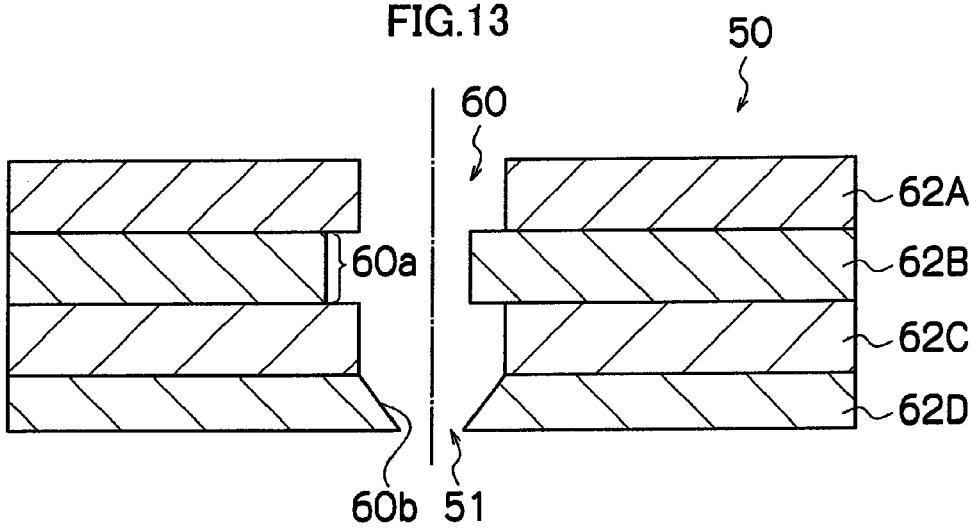
FIG. 13 is an enlarged cross-sectional diagram of the print head according to a third embodiment.

FIG. 13 is an enlarged cross-sectional diagram of the print head 50 according to a third embodiment. In the present embodiment, the cross-sectional shape (not illustrated) in the direction perpendicular to the axial direction of the nozzle flow channel 60 has congruence or similarity at any position in the axial direction, but the center of the cross-section of the portion of the nozzle flow channel 60 indicated by reference numeral 60*a* is shifted away from the axis of the nozzle flow channel 60. By positioning the center of the cross-section perpendicular to the axial direction, in one portion following the axial direction of the nozzle flow channel 60, in such a manner that it is shifted by a prescribed amount from the axis of the nozzle flow channel 60, then it is possible to obtain similar beneficial effects to those of the first and second embodiments described above.

The nozzle flow channel 60 of this kind can be manufactured readily by adopting a laminated structure of a plurality of thin plate-shaped members 62A, 62B, 62C and 62D, as shown in FIG. 13. There is no particular limitation on the number of layers of the plate members.

Figure 14:
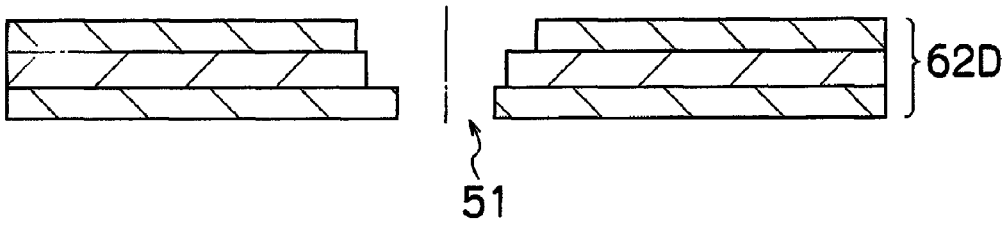
FIG. 14 is an enlarged cross-sectional diagram of a nozzle plate.

Furthermore, it is also possible to compose the plate member (nozzle plate) 62D in which the tapered sections 60*b* of the nozzle flow paths 60 are formed, from a plurality of thin plate-shaped members, as shown in FIG. 14, for example. By adopting a composition of this kind, in the tapered section 60*b* of the nozzle flow channel 60, similarly to the other sections, it is possible to change the cross-sectional shape perpendicular to the axial direction, along the course of the nozzle flow channel in the axial direction, and hence the effect of churning the ink is enhanced.

Fourth Embodiment

Figure 15:
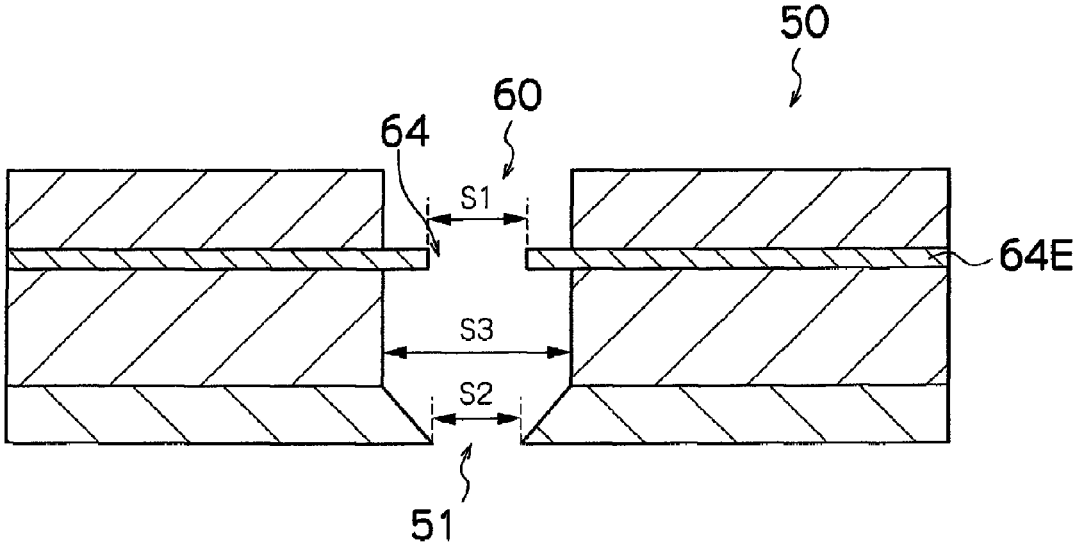
FIG. 15 is an enlarged cross-sectional diagram of the print head according to a fourth embodiment.

FIG. 15 is an enlarged cross-sectional diagram of the print head 50 according to a fourth embodiment. The vertical cross-sectional shape perpendicular to the axial direction of the nozzle flow channel 60 is formed with a congruous or similar shape, such as a circular shape or polygonal shape, for example, at each position along the axial direction, but a restrictor section 64 which narrows the cross-sectional area in the direction perpendicular to the axial direction is formed in a portion of the nozzle flow channel 60. The cross-sectional shape of the restrictor section 64 may be a similar shape to the other sections or it may be a dissimilar shape. Desirably, the cross-sectional area S1 of the restrictor section 64 is equal to or greater than the minimum cross-sectional area S2 of the nozzle 51. Moreover, desirably, the surface area S1 of the restrictor section 64 is equal to or less than ½ of the cross-sectional area S3 of the nozzle flow channel 60 (excluding the restrictor section 64). In the present embodiment, the cross-sectional area S1 of the restrictor section 64 is set to be approximately two times the minimum cross-sectional area S2 of the nozzle 51. By disposing the restrictor section 64 in one portion of the nozzle flow channel 60 in this way, it is possible to make the cross-sectional area of the other sections apart from the restrictor section 64 larger in comparison with the related art.

According to the present embodiment, non-uniform forces act at different positions in the axial direction, and similarly to the above-described embodiments, the ink inside the nozzle flow channel 60 is churned during meniscus vibration and therefore it is possible to prevent the increase in the viscosity of the ink.

The nozzle flow channel 60 of this kind can be manufactured readily, as shown in FIG. 15, by arranging a thin plate-shaped member 64E formed with hole sections corresponding to the restrictor sections 64, among the other plate members.

Fifth Embodiment

Figure 16:
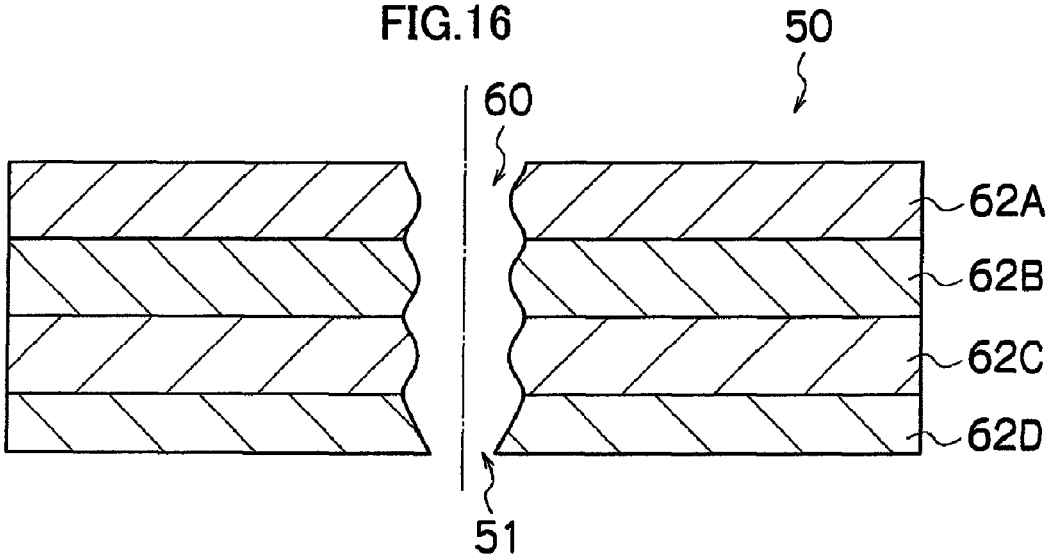
FIG. 16 is an enlarged cross-sectional diagram of the print head according to a fifth embodiment.

FIG. 16 is an enlarged cross-sectional diagram of the print head 50 according to a fifth embodiment. As shown in FIG. 16, the nozzle flow channel 60 is composed with an undulating shape having alternately repeating recesses and projections along its course in the axial direction, and the cross-sectional shapes perpendicular to the axial direction are substantially congruent shapes or similar shapes at all positions in the axial direction. The cross-sectional shape in the direction perpendicular to the axial direction is not shown in particular, but it is, for example, a circular shape or polygonal shape. The undulating cross-section may be a uniform structure in which a fixed recess and projecting shape is repeated, or it may be a non-uniform structure in which large and small recesses and projections are repeated at random. According to this composition of the nozzle flow channel 60, in the axial direction, there is a repetition of large sections and small sections in the cross-section perpendicular to the axial direction of the nozzle flow channel 60 (in other words, a composition equivalent to that of providing a plurality of restrictors inside the nozzle flow channel 60 is achieved), and therefore the ink moving back and forth through the nozzle flow channel 60 during meniscus vibration receives repeatedly a compressing and expanding action, thereby promoting churning of the ink and thus making it possible effectively to prevent the increase in the viscosity of the ink.

With regard to the method of manufacturing the nozzle flow channel 60 according to the present embodiment, it is possible to etch either both surfaces or one surface of each of a plurality of thin plate-shaped members 62A, 62B, 62C and 62D, and to then bond these plate members together.

In chemical etching of metal plates made of stainless steel, or the like, there is a phenomenon known as side etching, which produces sag (a burred shape) of approximately 10% of the plate thickness in the case of double-face etching and approximately 20% of the plate thickness in the case of single-face etching. In the present embodiment, the side etching, which is usually suppressed, is increased in order to achieve a sag of 20% or above of the plate thickness in the case of double-face etching, and 40% or above of the plate thickness in the case of single-face etching. More specifically, the thin plate-shaped members 62A, 62B, 62C and 62D are manufactured by double-face etching of stainless steel having a plate thickness of 50 μm, and a sag of 10 μm or above is achieved. The diameter of the hole sections having a large cross-sectional diameter is 100 μm, and the diameter of the narrower sections caused by the sag is approximately 80 μm. In this case, the sections of larger and smaller cross-sectional area are joined together.

Sixth Embodiment

Figure 17:
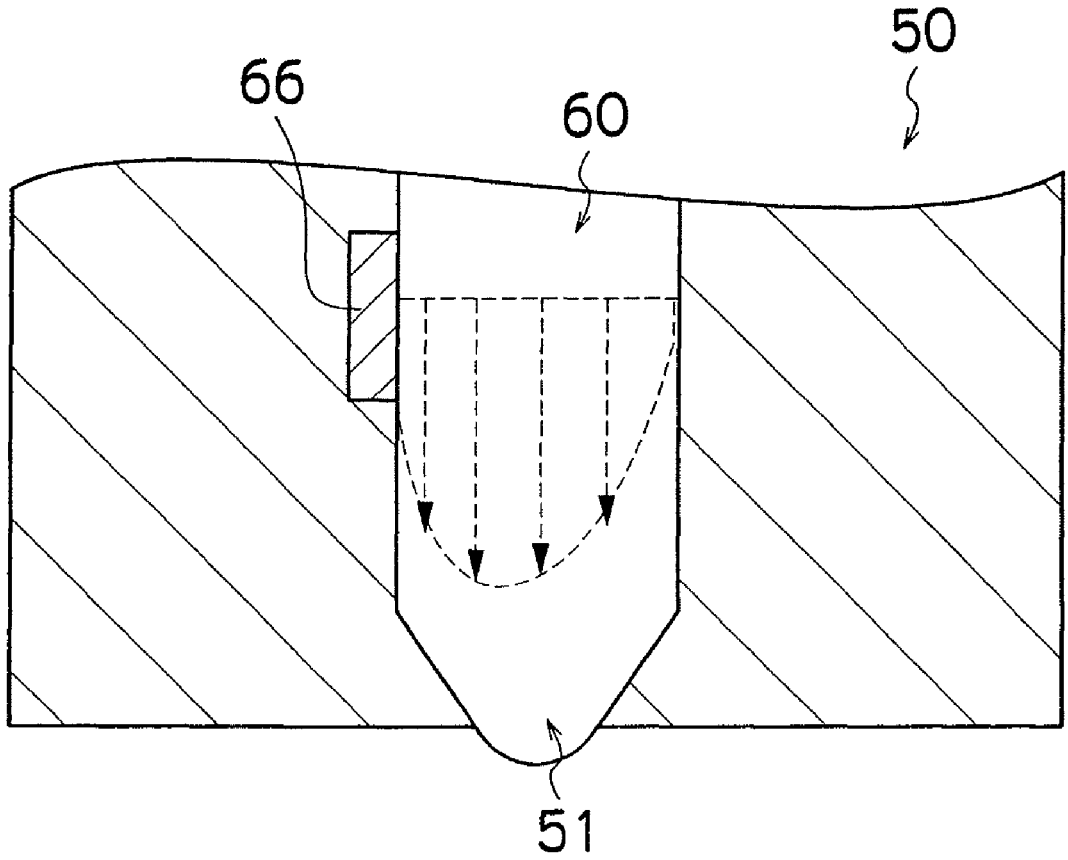
FIG. 17 is an enlarged cross-sectional diagram of the print head according to a sixth embodiment.

FIG. 17 is an enlarged cross-sectional diagram of the print head 50 according to a sixth embodiment. In the sixth embodiment, a heater 66 is arranged in one portion of the inner wall of the nozzle flow channel 60, in such a manner that the ink inside the nozzle flow channel 60 is locally heated during vibration of the meniscus. The heating by the heater 66 may be performed momentarily or continuously. When the ink is heated by the heater 66, the viscosity locally changes and the resistance locally falls, making the ink more fluid locally, and hence creating an imbalance in the ink flow speed. For example, an ink flow speed distribution such as that shown by the broken arrows in FIG. 17 is obtained. Consequently, ink churning is promoted and the increase in the viscosity of the ink is prevented.

FIG. 17 shows the embodiment of a composition in which one heater 66 is provided in the nozzle flow channel 60, but the implementation of the present invention is not limited to this, and it is also possible to provide a plurality of heaters 66.

Figure 18A:
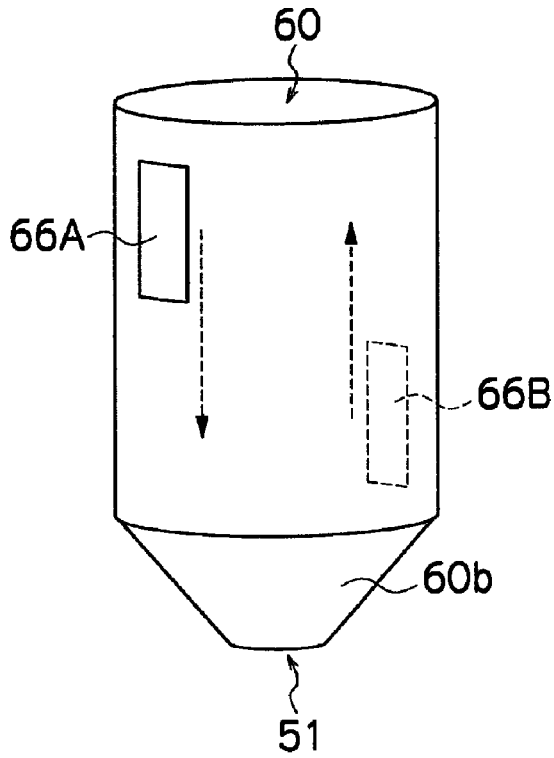
FIGS. 18A and 18B are oblique diagrams showing three-dimensional representations of the internal structures of nozzle flow channels in which a plurality of heaters are provided.
Figure 18B:
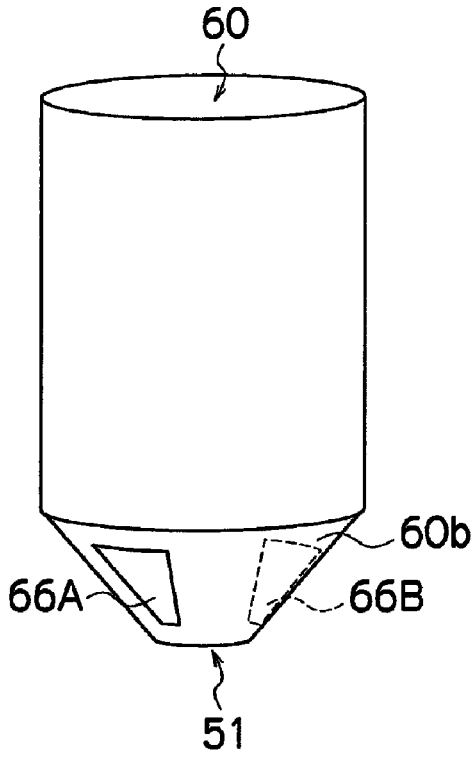

FIGS. 18A and 18B are oblique diagrams which show a three-dimensional representation of the internal structure of the nozzle flow channel 60, and they show modified embodiments in which a plurality of heaters 66A and 66B are arranged. As shown in FIG. 18A, by disposing heaters 66A and 66B at different heights in positions opposing to each other on the wall of the nozzle flow channel 60, the ink becomes more liable to flow in the directions indicated by the broken arrows in FIG. 18A, and therefore it is possible to promote churning of the ink during vibration of the meniscus. Furthermore, as shown in FIG. 18B, heaters 66A and 66B may be disposed in the tapered section 60*b* of the nozzle flow channel 60, in such a manner that increase in the viscosity of the meniscus formed in the vicinity of the nozzle 51 can be restricted reliably.

Figure 19A:
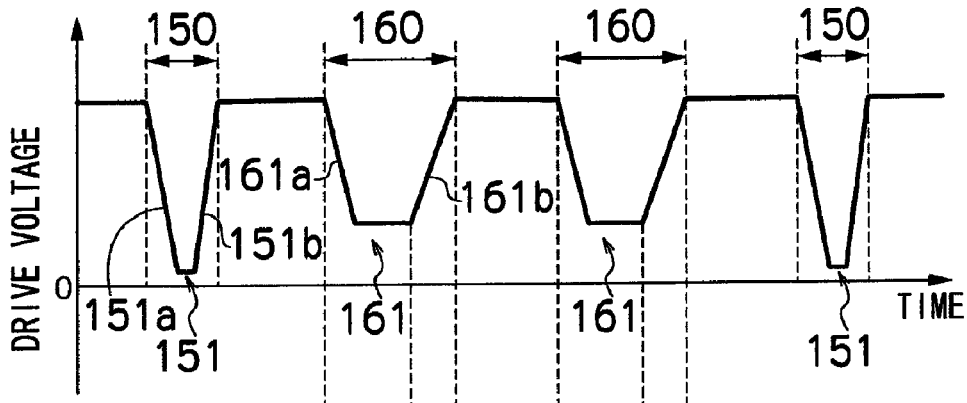
FIGS. 19A to 19D are waveform diagrams showing the drive timing of the heaters.
Figure 19B:
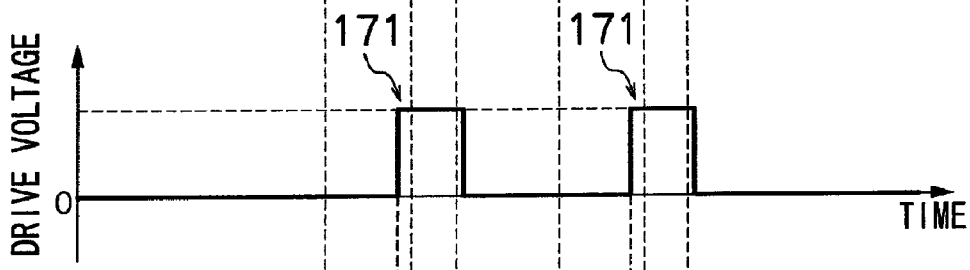
Figure 19C:
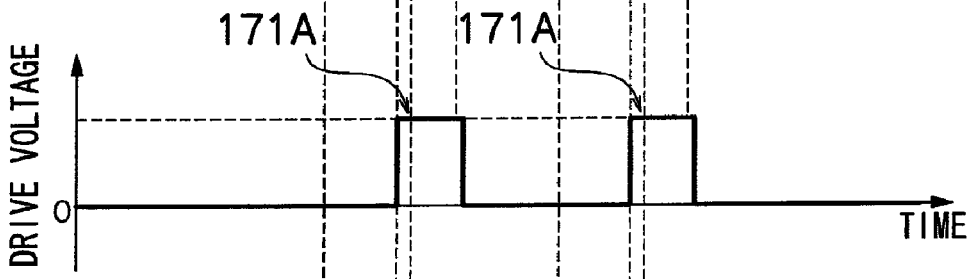
Figure 19D:
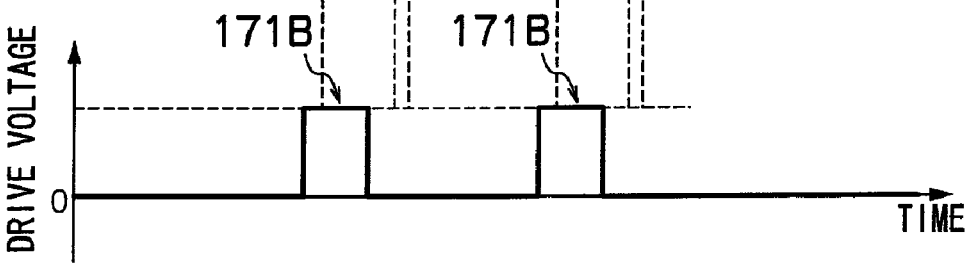

FIGS. 19A to 19C are waveform diagrams for showing the drive timing of the heaters. FIG. 19A shows a drive waveform applied to the piezoelectric element 58 (see FIG. 4). FIG. 19B shows a heater drive waveform applied to one heater 66 shown in FIG. 17. Furthermore, FIG. 19C shows a heater drive waveform applied to two heaters 66A and 66B shown in FIG. 18A or 18B.

In FIG. 19A, the waveform 151 in the period 150 is an ejection drive waveform during ejection of an ink droplet from the nozzle 51, and the waveform 161 in the period 160 is a slight vibration drive waveform for creating a pulsation of the meniscus (in other words, slight vibration of the meniscus). The meniscus in the vicinity of the nozzle 51 is pulled by the falling waveforms 151*a* and 161*a* of the waveforms 151 and 161, and the meniscus is pushed by the rising waveforms 151*b* and 161*b*. An ink droplet is ejected from the nozzle 51 in the rising waveform 151*b*, and no ink droplet is ejected in the rising waveform 161*b*.

When the number of heater is one, then as shown in FIG. 19B, a heater drive waveform 171 is applied to the single heater 66 before the application timing of the rising waveform 161*b*, and the application of the heater drive waveform 171 is halted at the same time as, or after, the end of application of the rising waveform 161*b*. By adopting this composition, the ink in the vicinity of the heater is accelerated to a greater extent when flowing toward the nozzle 51, and furthermore, the ink is churned to a greater extent (in other words, caused to perform a circulating motion) by the tapered shape of the nozzle section.

Furthermore, if there are two heaters, then as shown in FIG. 19C, the heater drive waveform 171A is applied to one of the heaters 66A (or 66B) before the application timing of the rising waveform 161*b*, and the application of the heater drive waveform 171A is halted at the same time as, or after, the end of application of the rising waveform 161*b*, whereas the heater drive waveform 171B is applied to the other heater 66B (or 66A) before the application timing of the falling waveform 161*a*, and the application of the heater drive waveform 171B is halted before the application timing of the rising waveform 161*b*.

The relationship between the start timing of the application of the heater drive waveform 171A and the end timing of the application of the heater drive waveform 171B is determined on the basis of the thermal conductivity of the heaters and the ink, and the like. If the thermal conductivity is high and the ink is heated rapidly, then the application of the heater drive waveform 171A starts after the end of application of the heater drive waveform 171B (see FIG. 19C), whereas conversely, if the thermal conductivity is low and the ink heats up slowly, then the application of the heater drive waveform 171A is started before the end of application of the heater drive waveform 171B.

In either of these cases, the heaters (66, 66A and 66B) are driven in synchronism with the slight vibration drive waveform 161, and hence the ink inside the nozzle flow channel 60 can be heated locally in a highly efficient manner in conjunction with the pulsation of the meniscus. Therefore, the churning action can be promoted yet further. Moreover, it is possible to heat the ink effectively by predicting the time lag from the generation of heat by the heaters (66, 66A and 66B) until local warming of the ink inside the nozzle flow channel 60 is obtained, and furthermore, a composition which prevents excessive heating can also be achieved.

Seventh Embodiment

Figure 20:
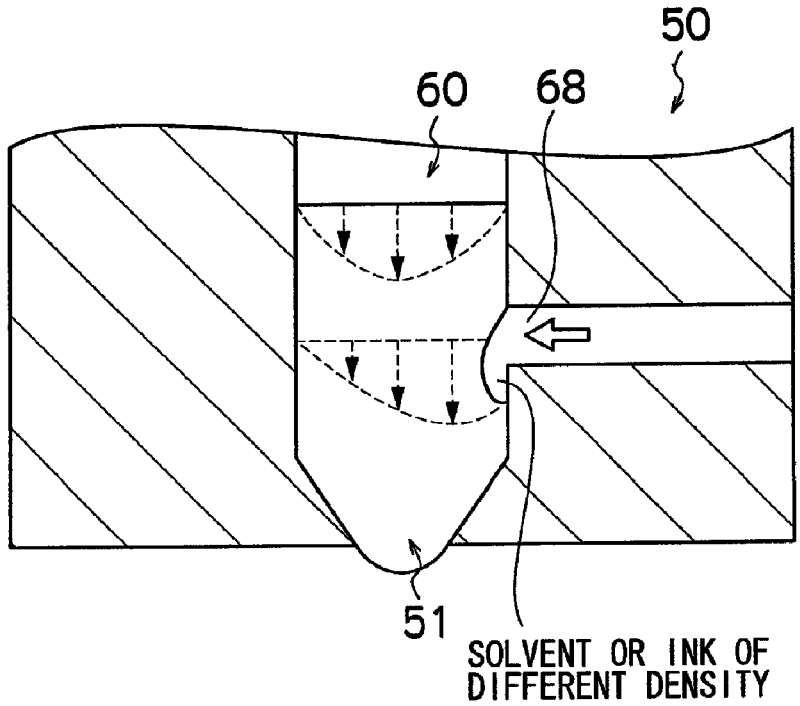
FIG. 20 is an enlarged cross-sectional diagram of the print head according to a seventh embodiment.

FIG. 20 is an enlarged cross-sectional diagram of the print head 50 according to a seventh embodiment. In the present embodiment, an injection port 68 is formed in one side face of the nozzle flow channel 60. A solvent or ink of density different from the ink existing in the nozzle flow channel 60 is injected from the injection port 68 into the nozzle flow channel 60 during vibration of the meniscus. The solvent or ink may be injected momentarily, or it may be injected in a continuous fashion. By injecting the solvent or ink into the nozzle flow channel 60 in this way, the viscosity of the ink inside the nozzle flow channel 60 is reduced locally, thereby reducing the resistance, and hence the ink becomes more fluid locally, creating an imbalance in the ink flow speed and thus promoting the churning of the ink.

Eighth Embodiment

Figure 21:
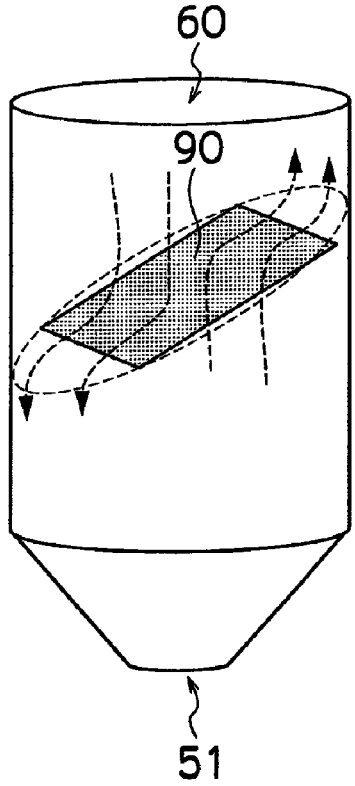
FIG. 21 is an oblique diagram showing a three-dimensional representation of the internal structure of a nozzle flow channel in a print head according to an eighth embodiment.

FIG. 21 is an oblique diagram showing a three-dimensional representation of the internal structure of the nozzle flow channel 60 in the print head 50 according to an eighth embodiment. In the present embodiment, an obliquely inclined rectangular-shaped plate member 90 is affixed with respect to the axial direction of the nozzle flow channel 60, and the ink is caused to flow through the spaces formed between the outer sides of the plate member 90 and the inner walls of the nozzle flow channel 60, in the direction of the downward broken arrow in FIG. 21 during pushing of the meniscus, and in the direction of the upward broken arrow in FIG. 21 during pulling of the meniscus. In the case of a composition of this kind also, it is possible to churn the ink during vibration of the meniscus.

Ninth Embodiment

Figure 22:
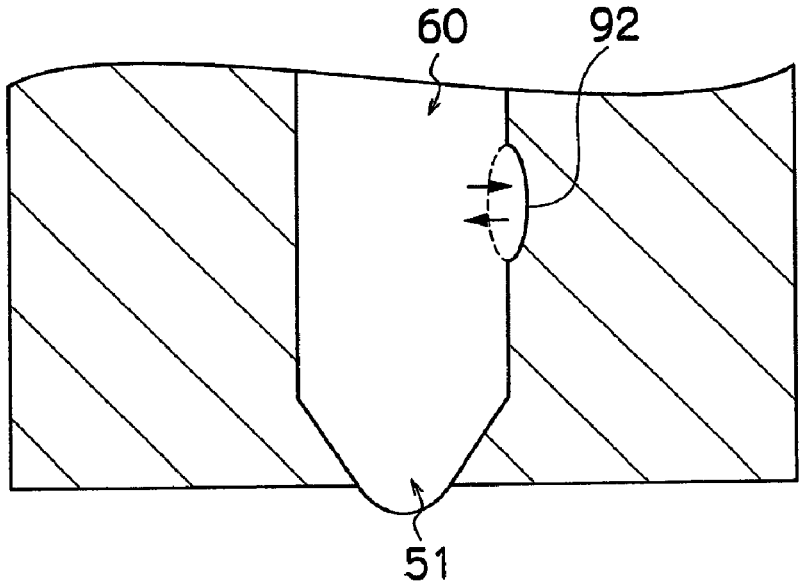
FIG. 22 is an enlarged cross-sectional diagram of the print head according to a ninth embodiment.
Figure 23:
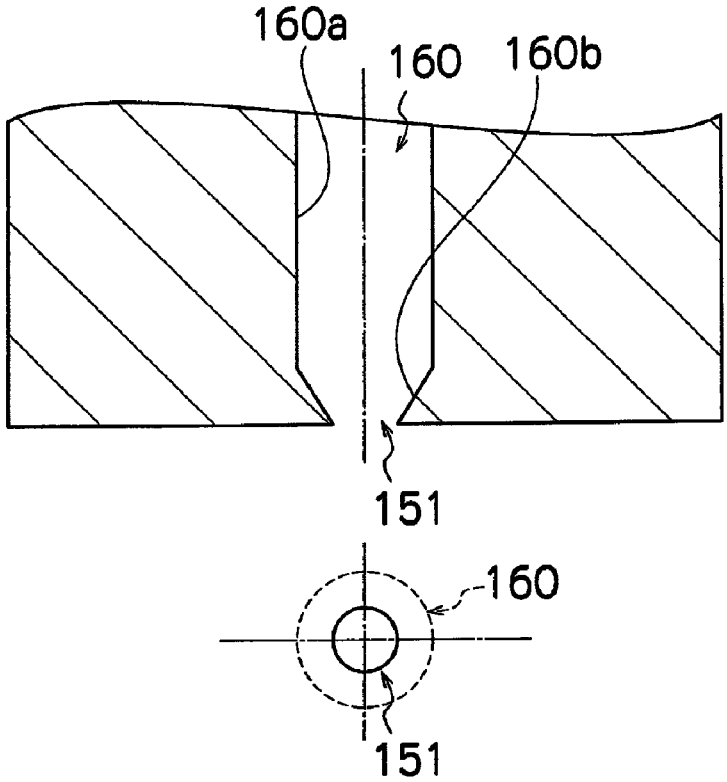
FIG.23 RELATED ART
FIG. 23 shows a cross-sectional diagram and a plan diagram of a nozzle flow channel of a print head in the related art.
Figure 24:
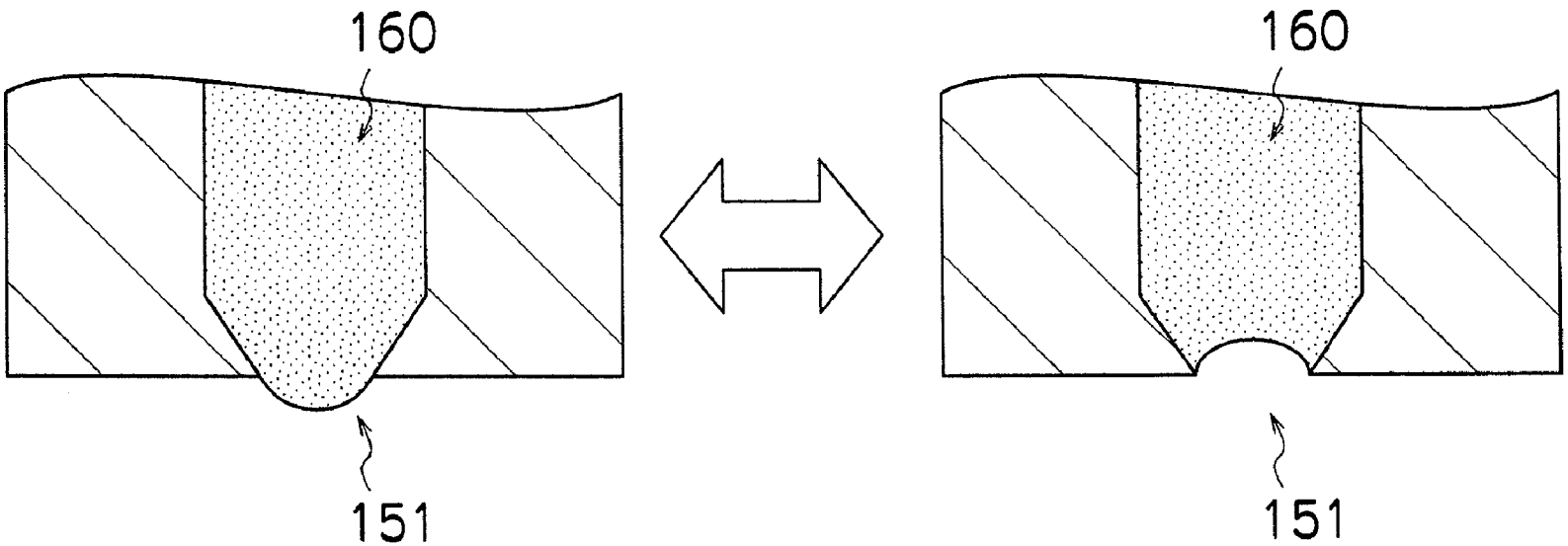
FIG.24 RELATED ART
FIG. 24 is an illustrative diagram showing the aspect of meniscus vibration.
Figure 25:
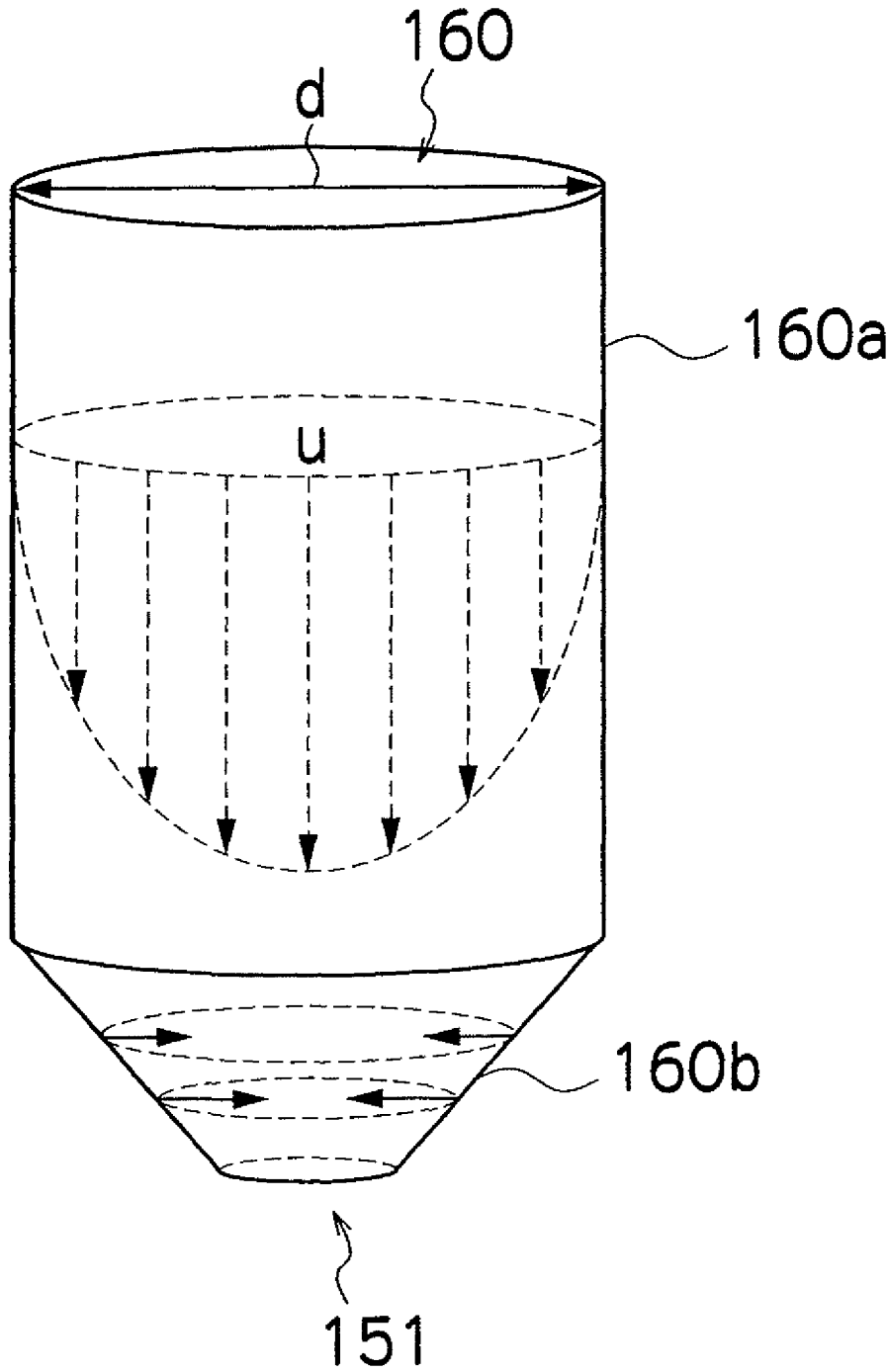
FIG.25 RELATED ART
FIG. 25 is an oblique diagram which shows a three-dimensional representation of the internal structure of the nozzle flow channel in the print head in the related art.

FIG. 22 is an enlarged cross-sectional diagram of the print head 50 according to a ninth embodiment. In the present embodiment, an elastic movable film 92 is provided in one portion of the wall of the nozzle flow channel 60. This elastic movable film 92 is made to perform a repeated compressing and expanding action by the ink moving back and forth inside the nozzle flow channel 60 in synchronism with the vibration of the meniscus during meniscus vibration, and hence the churning of the ink is promoted.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head, comprising:

a nozzle from which liquid is ejected during an ejection period;

a pressure chamber which accommodates the liquid to be ejected from the nozzle;

a pressurizing device which deforms to pressurize the liquid in the pressure chamber to eject the liquid from the nozzle;

a nozzle flow channel through which the pressurized liquid flows from the pressure chamber to the nozzle; and a heater which is arranged at a portion of an inner wall of the nozzle flow channel and heats the liquid during a vibration period of a meniscus of the liquid, which is a different period from the ejection period of the liquid from the nozzle.

2. The liquid ejection head as defined in claim 1, wherein a first heater and a second heater are arranged at portions of the inner wall at different heights in an axial direction of the nozzle flow channel and opposing to each other.

3. The liquid ejection head as defined in claim 1, wherein the heater heats the liquid locally in the nozzle flow channel.

4. The liquid ejection head as defined in claim 1, wherein the heater heats the liquid momentarily.

5. The liquid ejection head as defined in claim 1, wherein the heater heats the liquid continuously.

6. The liquid ejection head as defined in claim 1, wherein the heater is provided in a vicinity of the nozzle.

7. The liquid ejection head as defined in claim 1, wherein the nozzle flow channel has a tapered section in a vicinity of the nozzle, and the heater is provided in the tapered section.

8. An image forming apparatus, comprising the liquid ejection head as defined in claim 1.

9. The liquid ejection head as defined in claim 1, wherein the ejection period includes at least a falling waveform and a rising waveform, and an ink droplet is ejected from the nozzle in the rising waveform of the ejection period, and wherein the vibration period includes at least a falling waveform and a rising waveform, and no ink droplet is ejected in the rising waveform of the vibration period.

* * * * *